US007004717B2

(12) United States Patent
Marincic et al.

(10) Patent No.: US 7,004,717 B2
(45) Date of Patent: Feb. 28, 2006

(54) PLATE CASSETTE LOADER FOR PLATESETTER

(75) Inventors: Thomas P. Marincic, Tyngsboro, MA (US); Aron Mirmelshteyn, Marblehead, MA (US); Joseph R. Lyons, Jr., Willmington, MA (US); Matthew T. Kowalczyk, Somerville, MA (US)

(73) Assignee: Agfa Corporation, Wilmington, MA (US)

( * ) Notice: Subject to any disclaimer, the term of this patent is extended or adjusted under 35 U.S.C. 154(b) by 343 days.

(21) Appl. No.: 10/117,482

(22) Filed: Apr. 5, 2002

(65) Prior Publication Data

US 2003/0190225 A1 Oct. 9, 2003

(51) Int. Cl.
*B41F 27/06* (2006.01)
*B41L 29/16* (2006.01)

(52) U.S. Cl. ..... 414/779; 101/477; 101/480; 101/483; 414/782

(58) Field of Classification Search ..... 101/477, 101/480, 483; 414/764, 778, 779, 782
See application file for complete search history.

(56) References Cited

U.S. PATENT DOCUMENTS

| | | | | |
|---|---|---|---|---|
| 4,220,239 | A * | 9/1980 | Prichard, Jr. | 198/403 |
| 5,055,875 | A | 10/1991 | Fischer et al. | 355/89 |
| 5,218,907 | A * | 6/1993 | Komori et al. | 101/415.1 |
| 5,367,360 | A | 11/1994 | McIlwraith et al. | 355/85 |
| 5,537,926 | A * | 7/1996 | Beisel et al. | 101/477 |
| 6,113,346 | A | 9/2000 | Blake et al. | 414/811 |
| 6,393,986 | B1 * | 5/2002 | Tobe et al. | 101/477 |
| 6,510,795 | B1 * | 1/2003 | Detmers et al. | 101/480 |

* cited by examiner

*Primary Examiner*—Janice L. Krizek
(74) *Attorney, Agent, or Firm*—Robert A. Sabourin; Grant Houston

(57) ABSTRACT

A plate cassette loader for a platesetter comprises a cassette holder for receiving a cassette, containing a stack of plates. A cassette inverter then rotates this cassette to a feed position in which the plates can be fed into the imaging engine of the platesetter. In this way, the somewhat unwieldy process of loading plates into the imaging engine is handled by the cassette inverter, in combination with the fact that the stack of plates, contained in the cassette, can be loaded in one step, rather than requiring the feeding of individual plates by a dedicated operator.

4 Claims, 9 Drawing Sheets

PLATE CASSETTE LOADER FOR PLATESETTER

BACKGROUND OF THE INVENTION

Plates are typically large substrates that have been coated with photosensitive or thermally-sensitive material layers. Depending on the type of plate, they can be sensitive or insensitive to ambient light. The plates are usually used in commercial printing operations. For large run applications, the substrates are fabricated from aluminum, although organic substrates, such as polyester or paper, are also available for smaller runs. Because of the composition, the plates can be somewhat heavy, especially in the context of a stack of relatively large plates.

Computer-to-plate printing systems are used to render digitally stored print content onto these printing plates. Typically, a computer system is used to drive an imaging engine of a platesetter. The engine selectively exposes the surfaces of these plates. In a common implementation, the plate is fixed to the outside or inside of a drum and then scanned with a modulated laser source in a raster fashion.

Typically, one of two different strategies is used to feed the plates to the imaging engine. In the simplest case, an operator manually places individual plates into a feeder that then conveys the plates through a feed port to the drum scanner. This approach, however, has some obvious drawbacks, since an operator must be dedicated to feeding the plates. Moreover, the printing system must be housed within a light-safe environment, if the plates being used have any sensitivity to ambient light. The alternative approach is to use a plate manager.

Plate managers typically house multiple plate cassettes. Each cassette holds tens of plates in a stack. For example, in one common implementation, each cassette holds about thirty to fifty plates. The plate manager selects plates from one of its cassettes and then feeds the plates, automatically, into the imaging engine.

In these designs, cassettes are loaded into the plate manager on separate tables. The tables are then raised and lowered inside the manager to bring the plates of a selected cassette into cooperation with a plate picker that grabs individual plates and feeds them to the imaging engine.

In some applications, the plates can be shipped and stored in these cassettes. In other cases, the plates are shipped to the end user in a crate and then transferred to the cassettes by an operator.

SUMMARY OF THE INVENTION

Some institutions that use these platesetters require or have a need for an automated solution for feeding plates to the imaging engine. It is not cost effective for these institutions to devote personnel to the task of feeding plates one at a time into the imaging engine. At the same time, however, these institutions may not have the space or the need for a full plate manager that can handle multiple cassettes, since these plate managers can be relatively large and expensive.

This need is addressed to some degree by proposed, automated plate de-crating solutions. These systems, however, can be somewhat dangerous, having many exposed moving parts and are susceptible to mis-feeding, either when the plate is initially engaged, or when it is being conveyed to the infeed port to the imaging engine. They further require a light-controlled environment.

The present invention concerns a plate cassette loader for a platesetter. The plate cassette loader comprises a cassette holder for receiving a cassette, containing a stack of plates. A cassette inverter then rotates this cassette to a feed position in which the plates can be fed into the imaging engine of the platesetter. In this way, the somewhat unwieldy process of loading plates into the imaging engine is handled by the cassette inverter, in combination with the fact that the stack of plates, contained in the cassette, can be loaded in one step, rather than requiring the feeding of individual plates by a dedicated operator.

In the present embodiment, the cassette holder comprises a frame into which the cassette is inserted by the operator. This frame comprises tracks for guiding the cassette upon insertion. Springs are used on either side of the cassette to urge the cassette into engagement with the tracks. These springs also help to constrain the cassette during its rotation by the cassette inverter. A latch is provided for retaining the cassette in the holder, especially during rotation to the feed position.

Plate picker is also preferably provided. It is installed on the cassette holder in the present invention to pick a plate from the stack of plates so that it can be fed to the imaging engine.

In the present configuration, the cassette is inserted into the cassette holder by the operator in a generally horizontal position. The cassette inverter then translates a mouth of the cassette to the infeed port, while raising a distal end of the cassette to pivot the cassette around a horizontal axis. In this way, it inverts the cassette from a generally horizontal orientation, for ease of loading by the operator, to a generally vertical orientation, compatible with the angle of the infeed port.

In order to rotate this cassette, the cassette inverter comprises an actuation system and an inverter track for guiding the movement of a distal end of the cassette. The present configuration mimics the operation of a four-bar linkage. A link arm connects between the cassette holder and a frame to control its movement.

In general, according to another aspect, the invention can also be characterized as a method for loading a plate cassette in a platesetter. This method comprises receiving a cassette containing a stack of plates, and then rotating the cassette to a feed position. Plates are then fed into an imaging engine of the platesetter.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
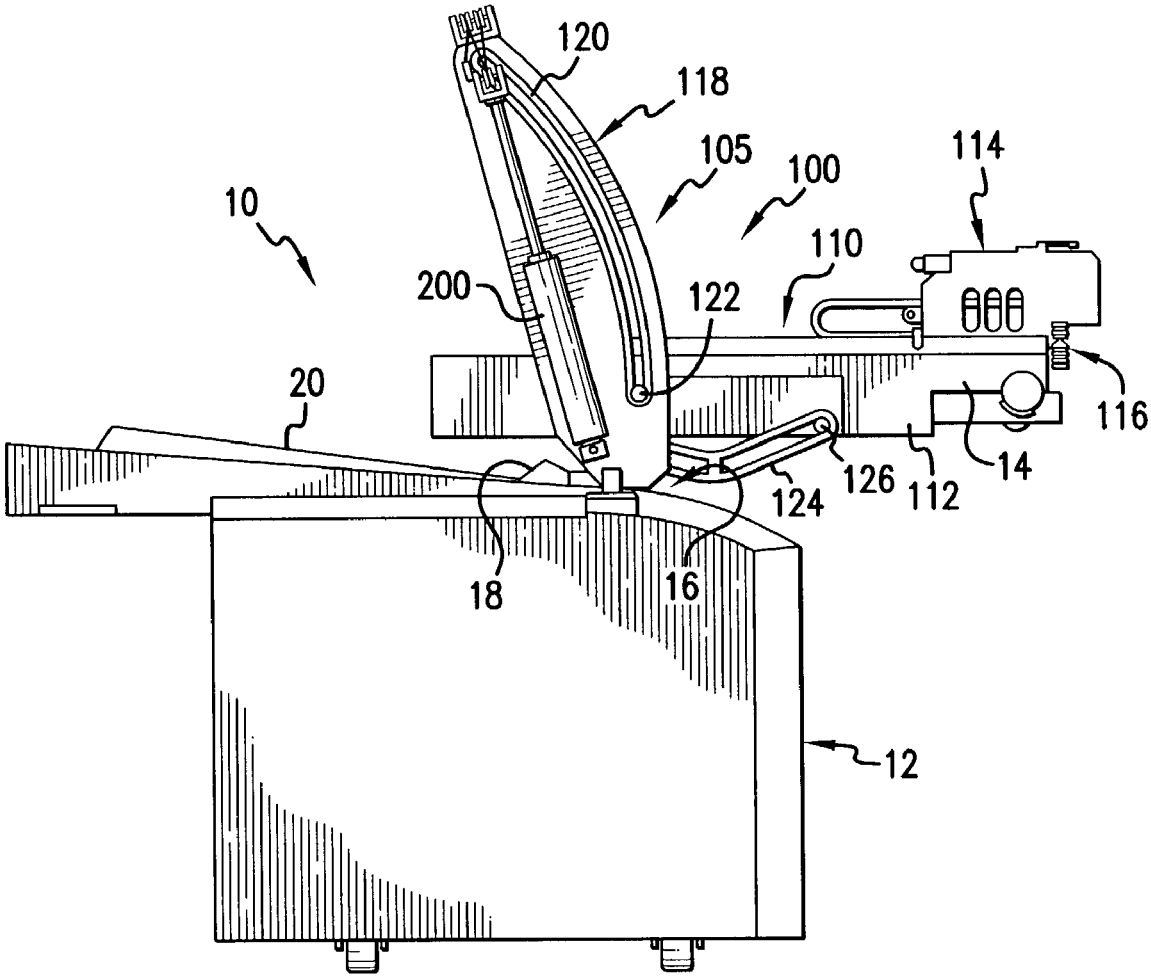
FIG. 1 is a side elevation showing the plate cassette loader in the load position and its relationship to the imaging engine of the platesetter, according to the present invention.

FIG. 1 shows a platesetter 10 with a plate cassette loader 100 comprising a cassette holder 110 and a cassette inverter 105, which have been constructed according to the principles of the present invention.

In more detail, the platesetter 10 generally comprises an infeed port 16 that conveys plates to an imaging engine in the general region of 12. The plates are typically loaded onto an imaging drum of the image engine and exposed, typically in a raster fashion by a scanning laser. Plates are thereafter ejected through an outfeed port 18 to a finished plate location 20. Thereafter, the plates are typically transported for further processing including development.

The plate cassette loader 100 generally comprises a cassette holder 110 and a cassette inverter 105.

The cassette holder 110 comprises a cassette frame 112. A cassette 14 is inserted into this frame 112 by an operator by sliding the cassette in the rearward direction into the frame 112.

The cassette holder 110 further comprises, in the illustrated embodiment, a plate picker system 114. This plate picker engages a top plate of a stack of plates held in the cassette 14, and then conveys that picked plate to the picker mouth 116.

The cassette inverter 105 comprises two stationary inverter arms 118 and two link arms 124. The inverter arms 118 generally extend vertically from the frame or body of the platesetter 10 in the fashion of a cantilever. Each inverter arm comprises an inverter track 120, which is generally arcuate, curving upward from the body of the platesetter and slightly rearward. A roller 122, which is journaled to the cassette frame 112, rides in and is confined by the inverter track 120 in the inverter arm 118.

One end of the link arm 124 is journaled to the inverter arm 118 near the base of the inverter arm 118, where it connects to the body of the platesetter 10. This allows the link arm 118 to pivot on the inverter arm 118. In the illustrated load position of FIG. 1, the link arm extends from the base of the inverter arm 118, generally forward. The proximal or other end of the link arm 124 is journaled to a pin 126 on the cassette frame 112.

Figure 2:
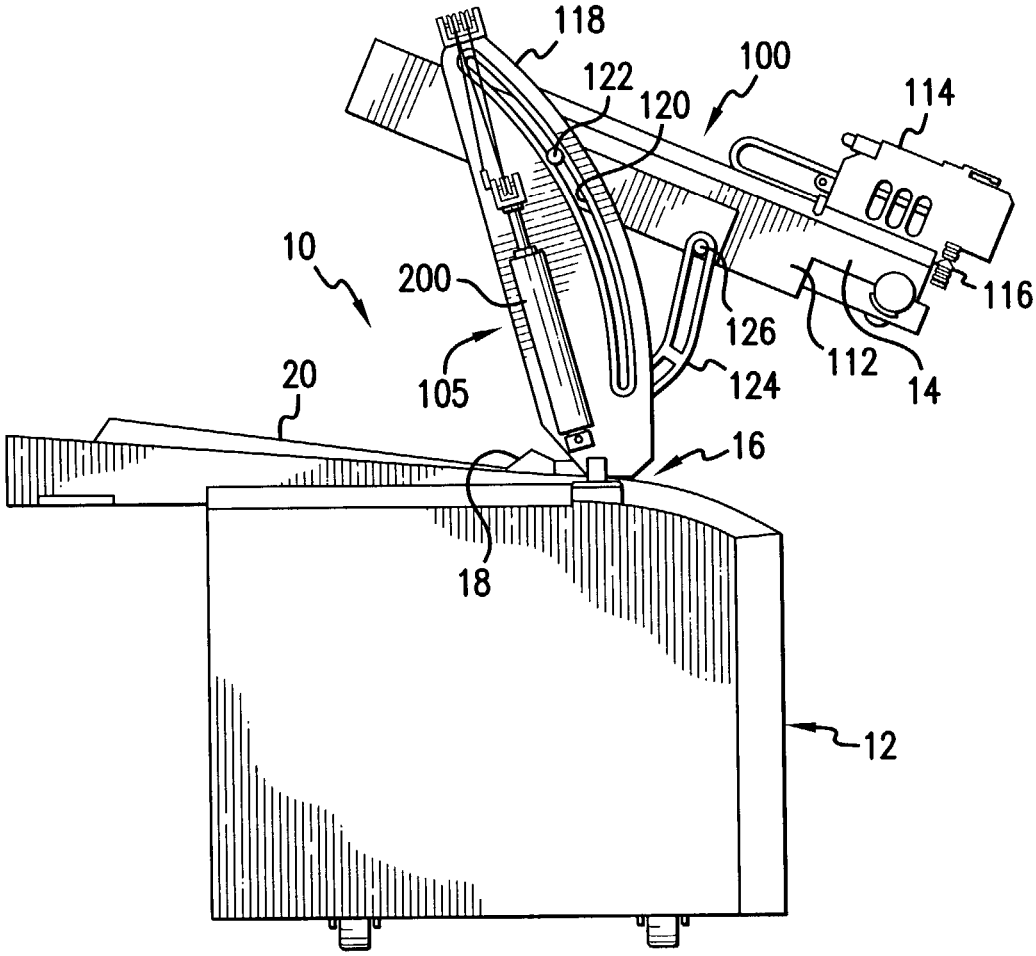
FIG. 2 is a side elevation showing the plate cassette loader in an intermediate phase of operation where it is rotating the cassette to a feed position, according to the present invention.

FIG. 2 shows the plate cassette loader 100 in an intermediate position, between a load position and a feed position. An actuation system 200 of the cassette inverter 105 is lifting the rear or distal end of the cassette 14 and frame 112, while lifting and rotating the proximal end of the cassette 14 in the rearward direction. This action moves the picker mouth 116 in the direction of the infeed port 16. The path of this translation and inversion of the cassette 14 is controlled by the movement of roller 122 in the inverter track 120, which constrain the movement of the distal end of the frame 112, while the path of the proximal end of the frame and cassette is controlled by the link arm 124.

Figure 3:
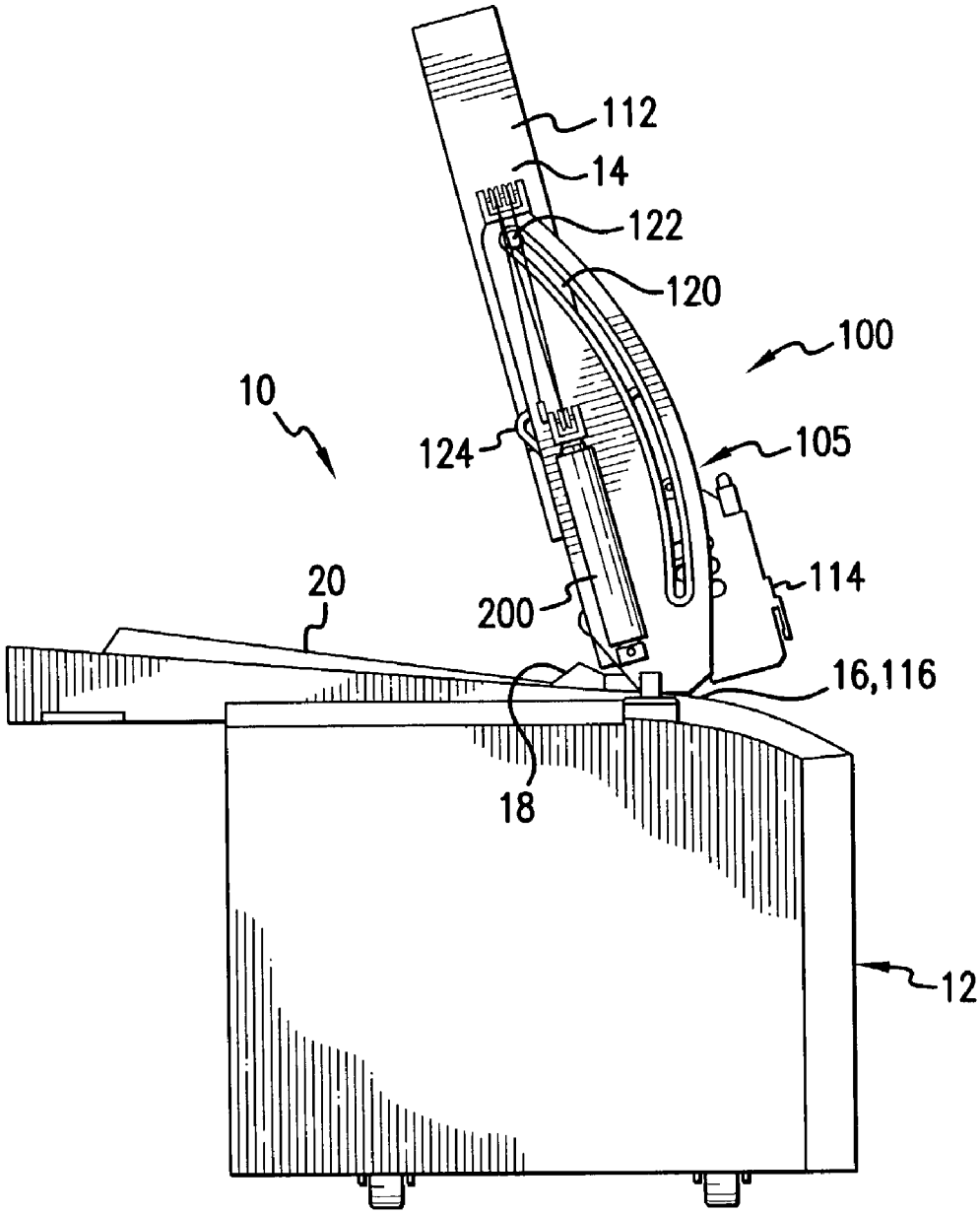
FIG. 3 is a side elevation showing the plate cassette loader at the feed position, according to the present invention.

FIG. 3 shows the plate cassette loader 100 in the feed position. In the illustrated embodiment, the cassette 14 is oriented in a position that is 15 degrees from vertical. It corresponds to the typical feed position for plates into the imaging engine 12.

An important aspect of the inverter's operation is the fact that the cassette 14 has never been moved through a vertical position. As a result, a stack of plates contained in the cassette will never be oriented such that they would not fall out of the cassette 14 or flop against a top of the cassette. This characteristic is important since, in the current implementation, the stack of plates is not constrained in the z-axis direction in the frame of reference of the cassette 14. The z-axis is orthogonal to the plane of the cassette (the vertical direction in the orientation of FIG. 1).

In this feed position, the picker mouth 116 is cooperating with the infeed port 16 of the imaging engine 12. This allows individual plates to be picked-off of the stack of plates in the cassette 14 and fed through the picker mouth 116, into the infeed port 16 and to the drum of the imaging engine 12.

Figure 4:
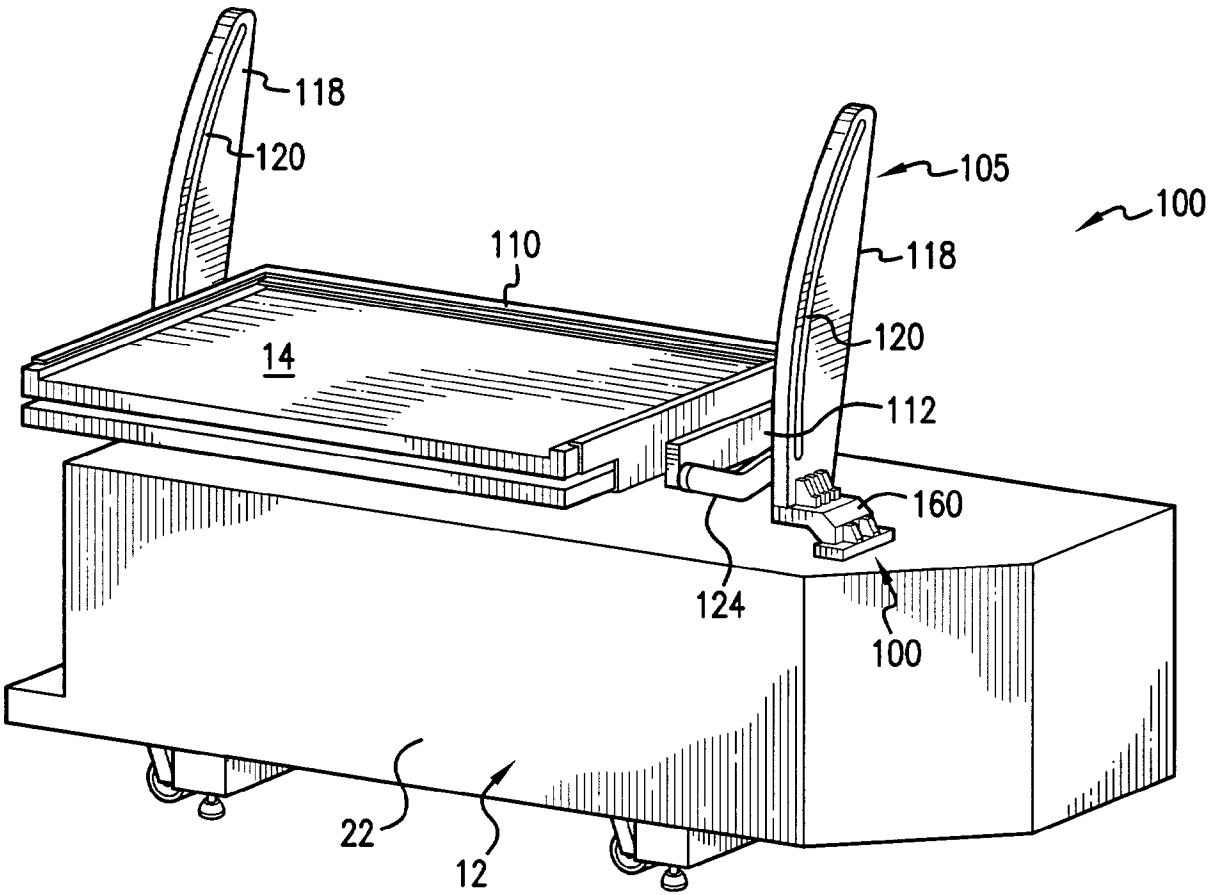
FIG. 4 is a front perspective schematic view showing the internal construction of the inventive cassette inverter.

FIG. 4 shows some more details of the plate cassette loader 100 and specifically the cassette holder 110 and the two inverter arms 118 of the cassette inverter 105, with the picker 114 removed. Specifically, the two arms 118 are located on either side of the cassette holder's frame 112. The inverter arms 118 are connected to the platesetter body 22 by corresponding brackets 160. The imaging engine 12 is located within the platesetter frame 22.

Figure 5:
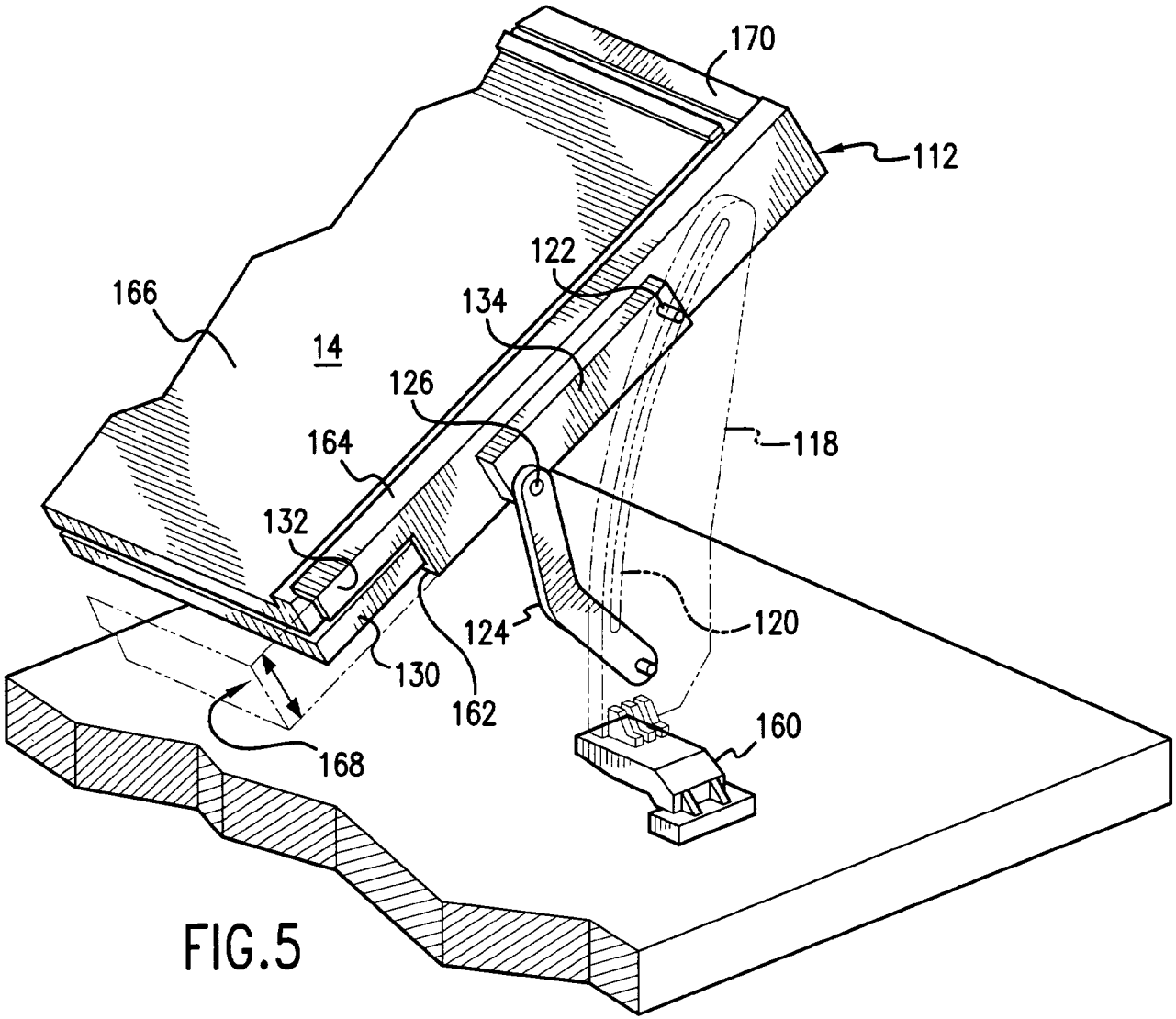
FIG. 5 is a perspective view showing the interaction between the inverter track, drive arm, and cassette frame during an intermediate stage of operation.

FIG. 5 is a more detailed view of the interconnection between the inverter arm 118 shown in phantom, the link arm 124, and the frame 112 of the cassette holder. Generally, the cassette frame 112 comprises a U-shaped member 132 that wraps under and over the cassette 14. Specifically, a lower leg 162 extends under a bottom of a tray portion 130 of the cassette 14. An upper leg 164 extends over a cover portion 166 of the cassette. A cross member 170 extends laterally across the cassette frame 112 to another U-shaped member on the other side of the frame.

The U-shaped member 132 defines an insertion channel 168 into which the operator inserts the cassette 14 between the upper and lower legs 164, 162 of the U-shaped member 132.

A reinforcing frame member 134 is attached to the side of the U-shaped member 132. It carries the journaled pin 126 that engages the link arm 124 to provide the pivot engagement and the roller 122 that rides in the inverter track of the inverter arm 118.

Figure 6:
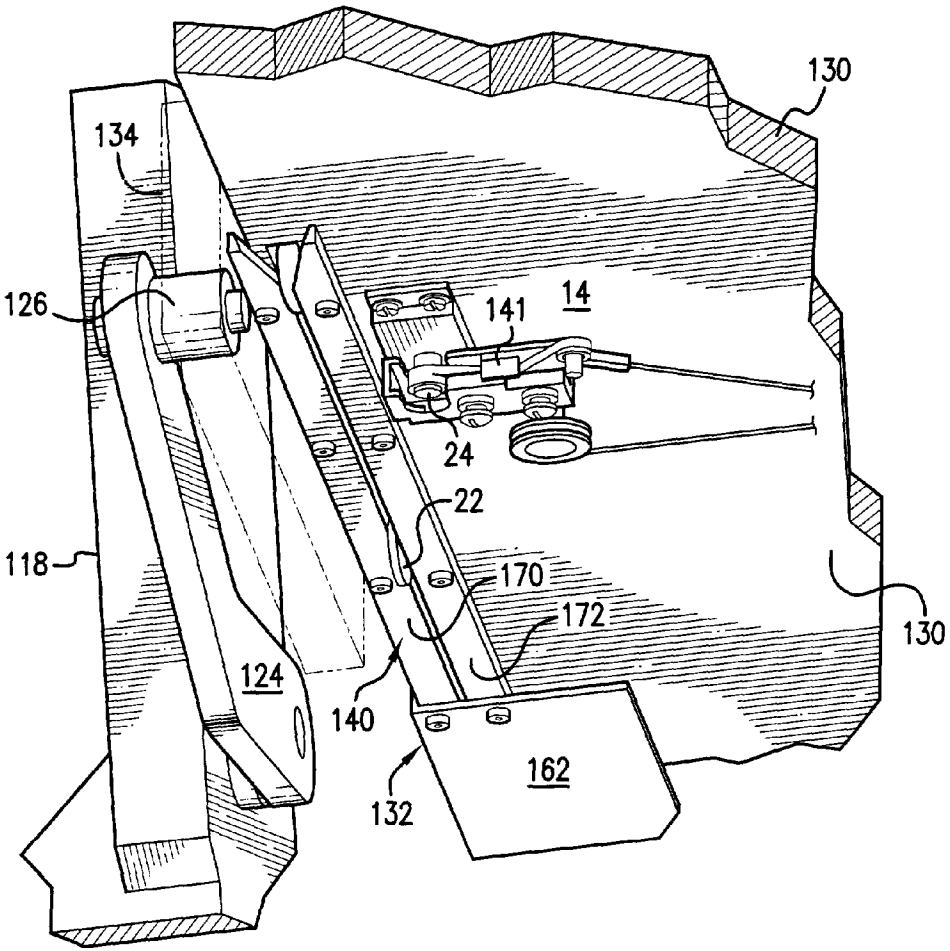
FIG. 6 is a perspective view of a section of the underside of the cassette frame showing a latch mechanism for holding the cassette in the cassette frame.

FIG. 6 shows an underside of the cassette frame and cassette 14 with the U-shaped member 132 partially cut-away. This exposes a track 140, which that is secured to the lower leg 162 of the U-shaped member 132. This track 140 comprises outer and inner rails 170, 172 are riveted to the lower leg 162. Wheels 22 of the cassette 14 ride in a V-shaped trough between these outer and inner rails 170, 172 so that the cassette 14 may be smoothly inserted into the channel between the U-shaped brackets 132 on either side of the frame.

Also shown is a latching mechanism 141, which is bolted to lower leg 162. The latching mechanism 141 is used to retain the cassette 14 in the channel of the cassette holder. Specifically, a pin 124, on the cassette 14, is provided that projects down from the bottom of the tray 130 of the cassette 14. Upon full insertion, it engages the latching mechanism 141 that is secured onto the lower leg 162. This latching mechanism 141 retains the pin 124, and thus holds the cassette 14 in the cassette holder 110 during the process of inverting the cassette 14 to the feed position.

Figure 7:
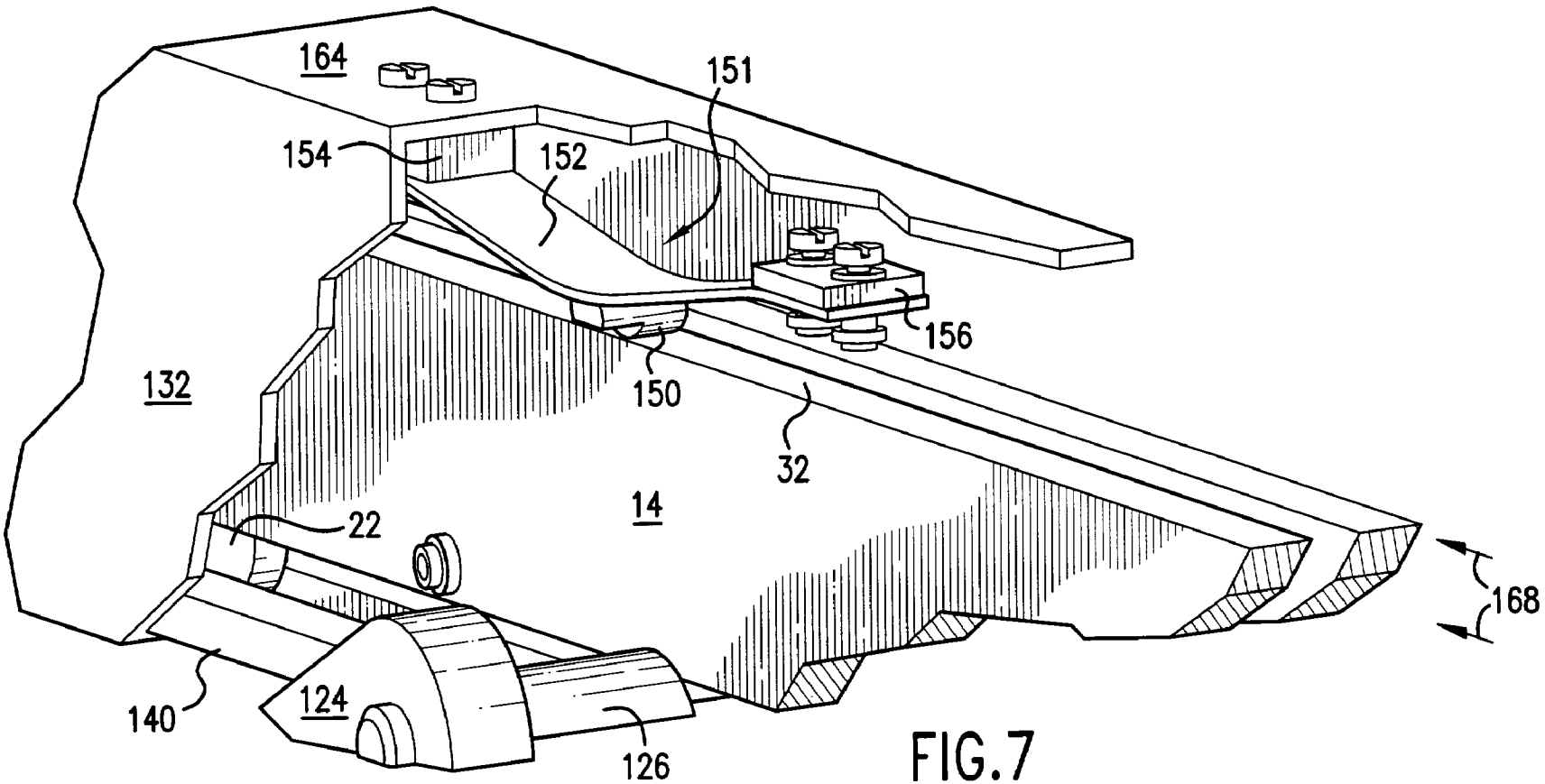
FIG. 7 is a side perspective view with partial cut-away showing a spring for constraining the movement of the cassette in the cassette frame.

FIG. 7 shows a spring member 151 that is used to constrain the cassette 14 in the channel defined by the U-shaped bracket 132. Specifically, two spring members are provided on each U-shaped member 132. The spring members 151 are secured to an inter side of the upper legs 164 such that they project down into the insertion channel 168. The spring members 151 each include a nib 150 that engages a top edge 32 of the cassette 14. The leaf spring portion 152 then urges the cassette 14 downward so that the wheels 22 stay within the track 140. The leaf spring portion is bolted to the upper leg 164 with intervening resilent blocks 154, 156. This way, the cassette 14 is securely held in the cassette holder 105 during its movement between the load position and the feed position.

Figure 8:
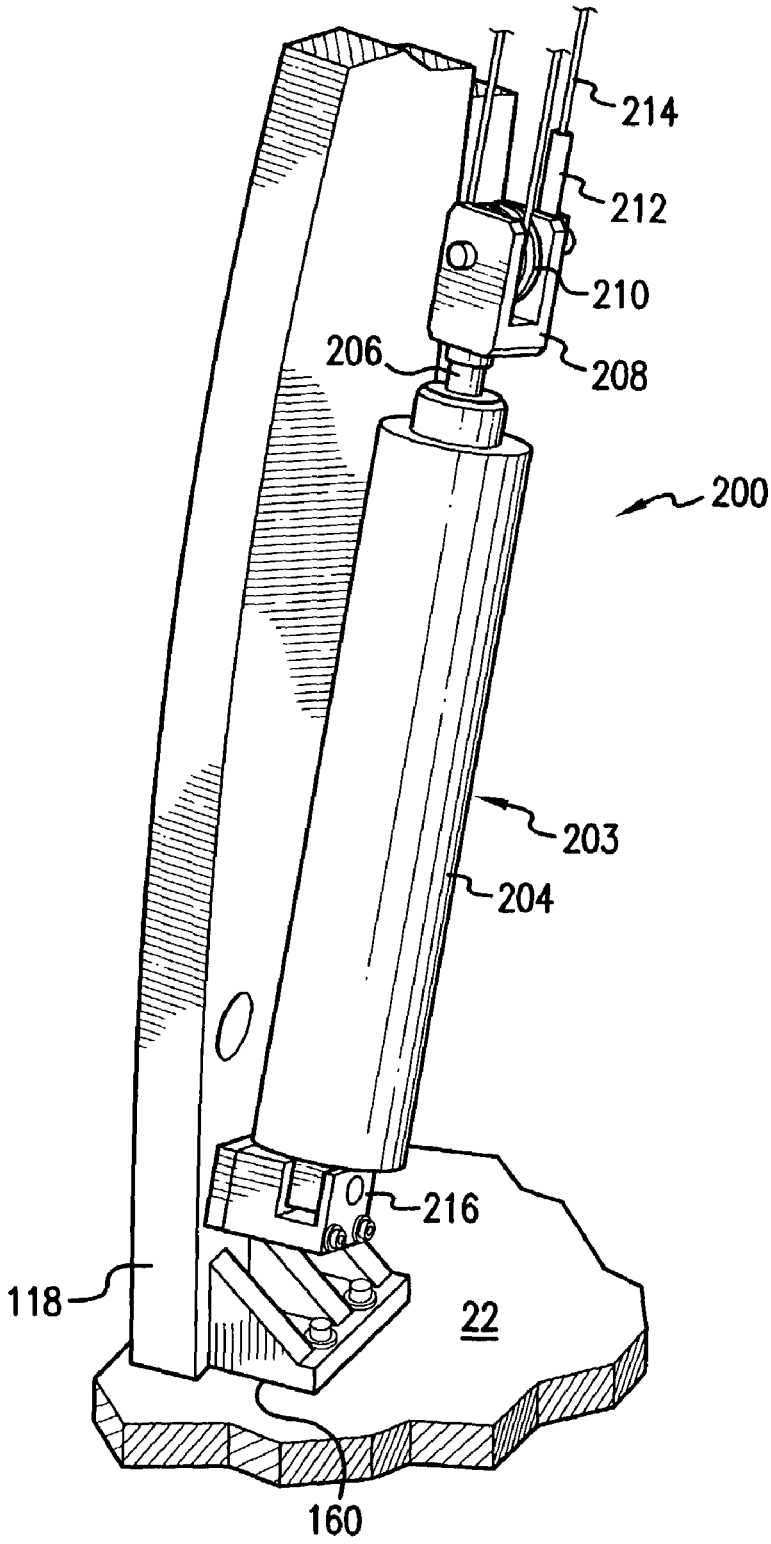
FIG. 8 is a perspective view showing an air cylinder actuation system for the cassette inverter.

FIG. 8 shows the detail of the actuation system 200. It comprises an air cylinder system 203, which includes an outer cylinder 204 and an inner piston 206. The cylinder's base is attached to a bracket 216 that is bolted to the inverter arm 118. A piston pulley block 208 is attached to the head of the piston 206. The piston pulley block 206 carries a pulley 210. Tackle wire 214 is further terminated 212 on the piston pulley block 206.

Figure 9:
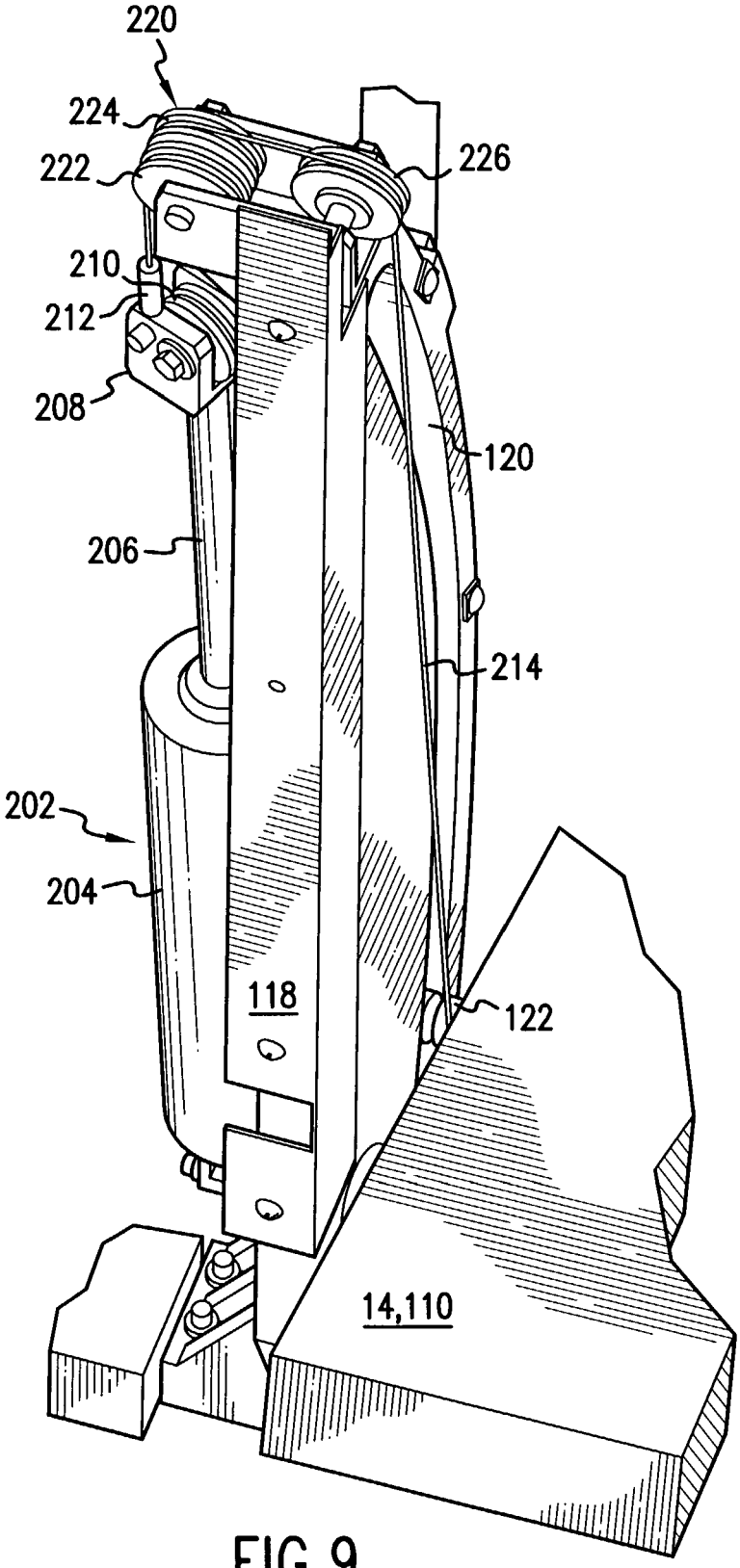
FIG. 9 is a perspective view showing a pulley system of the actuation system that provides mechanical advantage to the air cylinder.

FIG. 9 shows a top pulley block 220 that is attached at the top of the inverter arm 118. The wire tackle 214 extends from termination 212 over pulley 222 on the top block 220 to pulley 210 on the piston block 208, to pulley 224 on the top block 220. The tackle then runs over pulley 226, with the other end attaching to roller 122. In this way, the movement of the air cylinder system 202 is transferred to the cassette holder 110 and specifically controls the progress of the roller 122 in its track 120. The system of pulleys provides a mechanical advantage of one third (⅓). In the specific example, the piston displacement is 8 inches thereby moving the slide joint 24 inches.

While this invention has been particularly shown and described with references to preferred embodiments thereof, it will be understood by those skilled in the art that various changes in form and details may be made therein without departing from the scope of the invention encompassed by the appended claims.

What is claimed is:

1. A plate cassette loader for loading printing plates into an imaging engine of a platesetter, the loader comprising:

a cassette holder including a frame for holding a removeable cassette of printing plates, said frame having two fixed rollers and two fixed pins, and a cassette inverter fixedly connected to the platesetter, the cassette inverter comprising:

two stationary inverter arms each having a curvilinear track for engaging one of the rollers, said rollers moving along the tracks while the loader is moving the cassette holder between a horizontal loading position for loading the cassette of printing plates onto the cassette holder and a feed position for feeding printing plates from the cassette into an imaging engine of the platesetter, and two moveable link arms each having one end pivotally connected to one of the inverter arms and another end pivotally connected to one of the pins.

2. A plate cassette loader as claimed in claim 1, further comprising a plate picker installed on the cassette holder for picking a plate from the stack of plates to be fed to the imaging engine.

3. A plate cassette loader as claimed in claim 1, wherein the cassette inverter further comprises:

an air cylinder and a block and tackle system for moving the cassette holder.

4. A method for loading printing plates into an imaging engine of a platesetter, the method comprising the steps of:

loading a removeable cassette of printing plates in a horizontal loading position into a cassette holder including a frame for holding the cassette, two fixed rollers, and two fixed pins, and moving the cassette holder into a feed position of about 75 degrees from horizontal to position for feeding a printing plate from the cassette into the imaging engine using a cassette inverter fixedly connected to the platesetter, the cassette inverter comprising:

two stationary inverter arms each having a curvilinear track for engaging one of the rollers, said rollers moving along the tracks while moving the cassette holder between the horizontal loading position and the feed position, and two moveable link arms each having one end pivotally connected to one of the inverter arms and another end pivotally connected to one of the pins, and feeding a printing plate from the cassette into the imaging engine.

* * * * *